United States Patent [19]

Suefuji et al.

[11] Patent Number: 4,810,176

[45] Date of Patent: Mar. 7, 1989

[54] ANTI-ROTATION MECHANISM FOR USE WITH ORBITING SCROLL MEMBER OF SCROLL COMPRESSOR

[75] Inventors: Kazutaka Suefuji; Tetsuya Arata, both of Shimizu; Takao Senshu, Shizuoka; Jyoji Okamoto; Akira Murayama, both of Shimizu, all of Japan

[73] Assignee: Hitachi, Ltd., Tokyo, Japan

[21] Appl. No.: 119,486

[22] Filed: Nov. 12, 1987

[30] Foreign Application Priority Data

Nov. 19, 1986 [JP] Japan ..... 61-274041

[51] Int. Cl.[4] ..... F04C 18/04; F04C 27/00; F16D 3/04

[52] U.S. Cl. ..... 418/55; 418/57; 464/105

[58] Field of Search ..... 418/55, 57; 464/102, 464/104, 105

[56] References Cited

U.S. PATENT DOCUMENTS 3,924,977 12/1975 McCullough ..... 418/55
4,325,683 4/1982 Miyazawa ..... 464/104
4,396,364 8/1983 Tojo et al. ..... 418/55

FOREIGN PATENT DOCUMENTS 57-28890 2/1982 Japan ..... 418/55

*Primary Examiner*—John J. Vrablik
*Attorney, Agent, or Firm*—Antonelli, Terry & Wands

[57] ABSTRACT

In a scroll compressor, an anti-rotation mechanism is interposed between a back surface of an end plate of an orbiting scroll member and a flat surface of a frame facing the back surface. A seal mechanism or a thrust bearing portion is provided on the surfaces of a disc member of the anti-rotation mechanism which are maintained in contact with the back surface of the end plate of the orbiting scroll member and the flat surface of the frame.

4 Claims, 3 Drawing Sheets

ANTI-ROTATION MECHANISM FOR USE WITH ORBITING SCROLL MEMBER OF SCROLL COMPRESSOR

BACKGROUND OF THE INVENTION

1. Field of the Invention

The present invention relates generally to a scroll compressor of the type comprised of a casing including a compressor mechanism portion for compressing a gas therein, and more particularly to an anti-rotation mechanism for a scroll compressor, the overall size of which can be reduced, thereby enabling miniaturization of the scroll compressor.

2. Description of the Related Art

Such a scroll compressor comprises a fixed scroll member and an orbiting scroll member each including an end plate on which a spiral-shaped wrap is provided in an upright position. These scroll members are assembled in a superimposed manner with these wraps engaged with each other to allow the orbiting scroll member to orbit with respect to the fixed scroll member without rotating about its axis. The end plate of the fixed scroll member has a discharge port at its center and a suction port in its outer periphery, and a gas is drawn by suction through the suction port. Then the closed space defined by these scroll members is moved toward the center of the orbiting movement to reduce the volume of the closed space, thereby compressing the sucked gas. The thus-compressed gas is discharged through the discharge port.

As disclosed in, for example, U.S. Pat. No. 4,396,364, in such a scroll compressor, an anti-rotation mechanism for preventing the orbiting scroll member from rotating about its axis is interposed between a back surface of the orbiting scroll member opposite to its wrap and the surface of the frame facing the back surface.

A primary disadvantage of the prior anti-rotation mechanism is that no consideration is given to a reduction in the overall size of the compressor. Specifically, in order to seal a back pressure or bear a thrust force which acts upon the orbiting scroll member, the end plate of the orbiting scroll member is provided with an extension which does not influence the compression function of the compressor. As a result, the overall diametral size of the compressor must correspondingly be increased.

SUMMARY OF THE INVENTION

It is therefore an object of the present invention to provide an anti-rotation mechanism for use with an orbiting scroll member of a scroll compressor which enables a reduction in the diametral size of the scroll compressor.

It is another object of the present invention to provide an anti-rotation mechanism for use with an orbiting scroll member of a scroll compressor which also functions to define a closed space adjacent to the anti-rotation mechanism.

The above objects are achieved by the present invention which provides an anti-rotation mechanism which is interposed between the back surface of the end plate of the orbiting scroll member opposite to the wrap and the flat surface of the frame facing the back surface, the anti-rotation mechanism including a disc member having a seal mechanism or a thrust bearing portion on its surfaces maintained in contact with the back surface of the end plate and the facing flat surface of the frame.

Further objects, features, and advantages of the present invention will become apparent from the following description of preferred embodiments of the present invention with reference to the accompanying drawings.

DESCRIPTION OF THE PREFERRED EMBODIMENTS

Preferred embodiments of the present invention will be described below with reference to the accompanying drawings.

Figure 1:
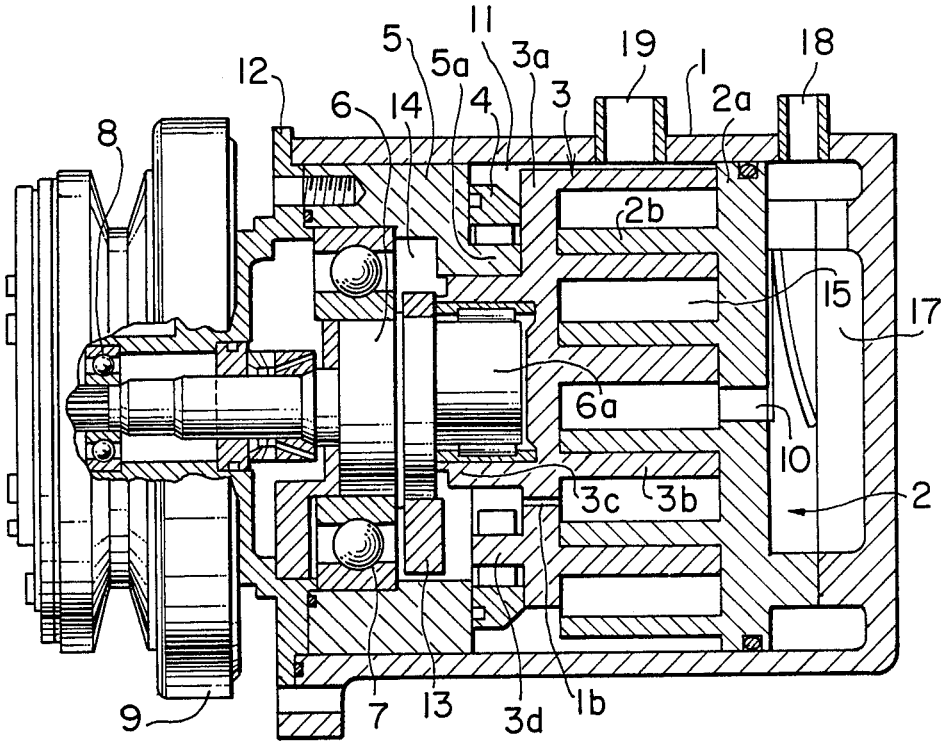
FIG. 1 is a partial longitudinal section of a scroll compressor incorporating a first preferred embodiment of an anti-rotation mechanism in accordance with the present invention.

FIG. 1 is a partial longitudinal section of a scroll compressor incorporating a first preferred embodiment of an anti-rotation mechanism in accordance with the present invention. A casing 1 includes a compressor section constituted by a fixed scroll member 2 and an orbiting scroll member 3, both of which are engaged with each other, as well as a drive section constituted by a combination of an Oldham's ring 4 serving as the anti-rotation mechanism, a frame 5, a crankshaft 6, and bearings 7, 8. A clutch 9 which is connected to the crankshaft 6 is disposed outside the casing 1.

The fixed scroll member 2 includes a disc-shaped end plate **2*a* and a wrap 2*b* which is formed thereon in its upstanding position. The wrap 2*b*, which is shaped in the form of an involute curve or a curve similar thereto, has a discharge port 10 at its center, and a suction chamber 11 is defined between the outer periphery of the fixed scroll member 2 and the facing inner wall of the casing 1. The orbiting scroll member 3 includes a disc-shaped end plate 3*a*, a wrap 3*b* which is formed thereon in its upstanding position and which has the same form as the wrap 2*b* of the fixed scroll member 2, and a boss portion 3*c* formed on the surface of the end plate 3*a* opposite to the wrap 3*b*. The bearing 7 is disposed in the central portion of the frame 5 while the bearing 8 is disposed in the central portion of an end plate 12 of the casing 1. The bearings 7 and 8 cooperate with each other in journaling the crankshaft 6. An eccentric portion 6*a*, which is formed at one end of the crankshaft 6, is inserted into the boss portion 3*c* to allow orbiting movement of the orbiting scroll member 3. A space for accommodating the bearing 7 and a balance weight 13 is defined in the casing 1 by the back surface of the end plate 3***a* of the orbiting scroll member 3 opposite to the wrap 3*b*. This space forms a back-pressure chamber 14 which is air tightly sealed with respect to the aforesaid suction chamber 11 by the anti-rotation mechanism 4 having a seal portion fitted into the gap between the back surface of the end plate 3*a* of the orbiting scroll member 3 and the surface of the frame 5 facing the back surface. The end plate 3*a* of the orbiting scroll member 3 has a small through hole 1*b* for communication between the back-pressure chamber 14 and a portion of a compression chamber 15 which is exposed to a suitable level of pressure. Therefore, the level of pressure within the back-pressure chamber 14 is maintained at an intermediate level between a discharge pressure and a suction pressure to press the orbiting scroll member 3 against the fixed scroll member 2, thereby enabling the compression chamber 15 to be air tightly closed. The casing 1 includes a discharge chamber 17 which is defined on the discharge side of the discharge port 10 formed in the fixed scroll member 2, and the discharge chamber 17 in turn communicates with a discharge pipe 18 connected to the casing 1. A suction pipe 19, which communicates with the suction chamber 11, is also connected to the casing 1.

In the scroll compressor having the above-described construction, as the eccentric portion 6*a* is caused to rotate about its eccentric axis by the rotation of the crankshaft 6 to which the clutch 9 is connected, the compression chamber 15 gradually moves toward the center of the orbiting movement of the orbiting scroll member 3 and thus the volume of the compression chamber 15 is correspondingly reduced. A low-pressure and low-temperature refrigerant gas is thus drawn by suction through the suction pipe 19 into the suction chamber 11, and is then compressed in the previously-described manner. The resultant high-pressure and high-temperature refrigerant gas is discharged through the central discharge port 10 into the discharge chamber 17 and in turn is discharged to the exterior through the discharge port 18.

Figure 2:
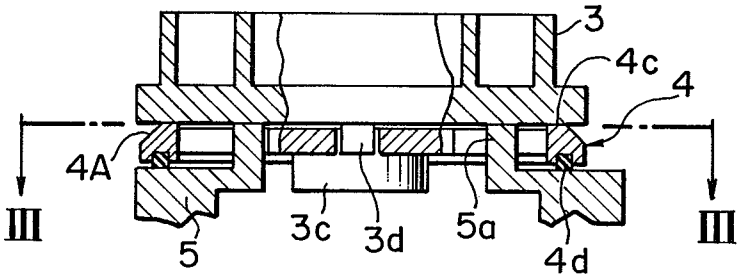
FIG. 2 is a longitudinal section of the essential portion of the anti-rotation mechanism shown in FIG. 1.
Figure 3:
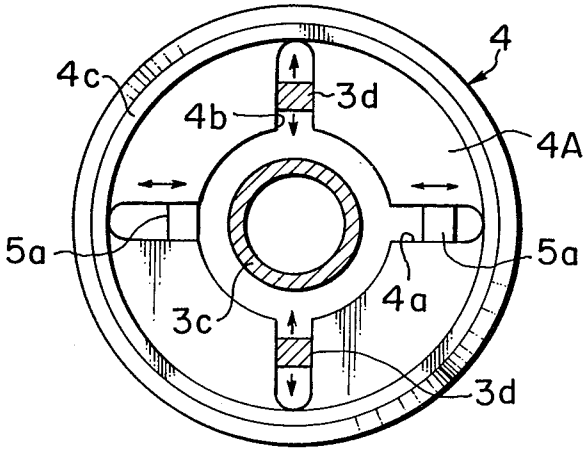
FIG. 3 is a cross section taken along the line III—III of FIG. 2.

The frame 5 is provided with keys 5*a* which are diametrically disposed as shown in FIGS. 2 and 3. The keys 5 are respectively slidably fitted into two keyways 4*a* formed in a disc member 4A which constitutes one part of the anti-rotation mechanism 4. The disc member 4A further includes two keyways 4*b* which are respectively formed at positions 90 degrees away from the keyways 4*a*. The keyways 4*b* respectively receive keys 3*d* which are diametrically formed on the back surface of the end plate 3*a* of the orbiting scroll member 3 opposite to the wrap 3*b*. The anti-rotation mechanism 4 having the above-described mechanism is adapted to move horizontally while the orbiting scroll member 3 and the keys 3*d* are adapted to move vertically as viewed in FIG. 3. Therefore, the orbiting scroll member 3 is capable of freely moving in a predetermined plane in a state wherein the member 3 is prevented from rotating about its axis. When the crankshaft 6 rotates with the eccentric portion 6*a* thereof fitted in a bearing, the orbiting scroll member 3 is caused to move in an orbiting manner without rotating about its axis.

The anti-rotation mechanism 4 has one surface which is maintained in contact with the back surface of the end plate 3*a* of the orbiting scroll member 3 to serve as a seal surface 4*c*. The other surface of the anti-rotation mechanism 4 has a ring-shaped groove into which a seal member 4*d* is fitted. The seal member 4*d*, which is made of a resilient material, is maintained in contact with the corresponding surface of the frame 5, thereby sealing a gas.

Figure 4:
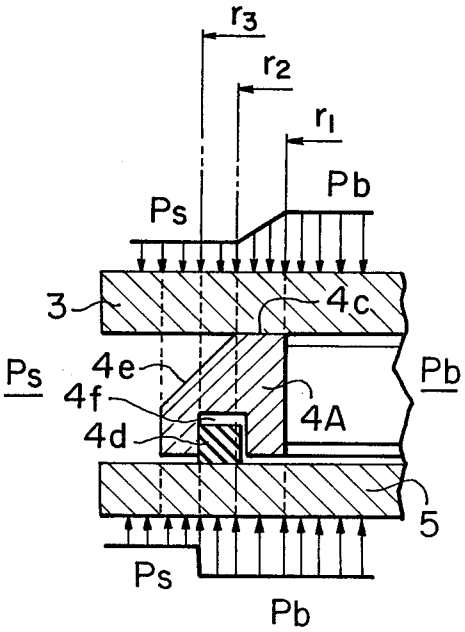
FIG. 4 is a diagram illustrating the operation of the anti-rotation mechanism in accordance with the present invention.

FIG. 4 is an illustration showing the sealing function of the anti-rotation mechanism 4 in accordance with the present invention. One surface of the disc member 4A of the anti-rotation member 4 is tapered at 4*e*, and one end surface of the disc member 4A is formed into a flat seat portion 4*c*. The surface opposite to the seat portion 4*c* has an annular groove 4*f*. The seal member 4*d* having a rectangular form in cross section and an annular form in plan view is fitted into the annular groove 4*f*. The level of pressure acting upon the area of a radius $r_1$ equals that of a back pressure Pb within the back-pressure chamber 14 of the orbiting scroll member 3. However, within a radius $r_2$ and a radius $r_3$, a suction pressure Ps acts upon the top side of the disc member 4A of the anti-rotation mechanism 4 which the back pressure Pb acts upon the bottom surface of the same, as viewed in FIG. 4. Accordingly, the disc member 4A is pressed upwardly as viewed in FIG. 4 and thus the seat portion 4*c* is air tightly pressed against the back surface of the orbiting scroll member 3, whereby the back pressure Pb and the suction pressure Ps are sealed. Simultaneously, the seal member 4*d* is pressed downwardly as viewed in FIG. 4 owing to the pressure Pb within the groove 4*f* so that the bottom surface of the seal member 4*d* is air tightly pressed against the top surface of the frame 5 as viewed in FIG. 4. Thus the back pressure Pb and the suction pressure Ps are likewise sealed. Specifically, a gas under the back pressure Pb within the Oldham's ring 4 and a gas under the suction pressure Ps outside the same are sealed and thus leakage of the gases is prevented.

Figure 5:
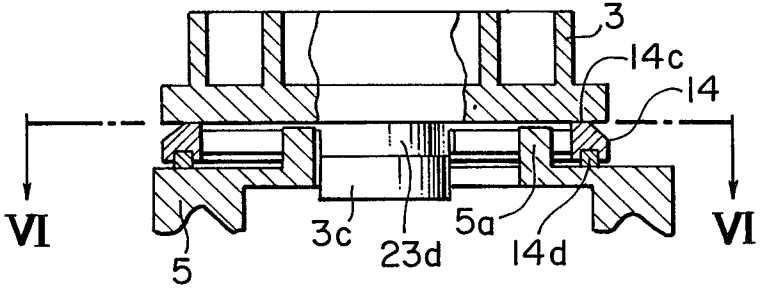
FIG. 5 is a longitudinal section of the essential portion of a second preferred embodiment of the anti-rotation mechanism in accordance with the present invention.
Figure 6:
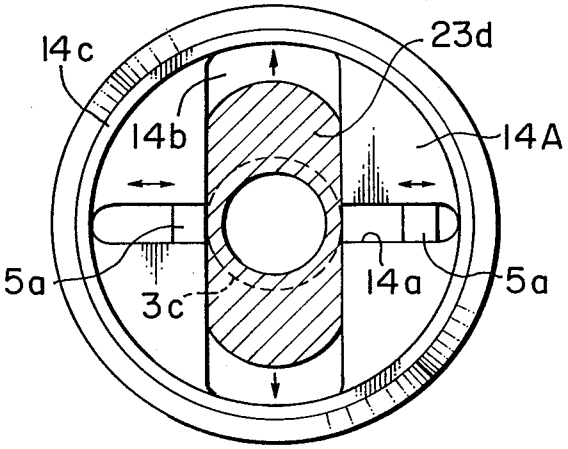
FIG. 6 is a cross section taken along the line VI—VI of FIG. 5.

FIG. 5 illustrates a second preferred embodiment of the anti-rotation mechanism in accordance with the present invention, FIG. 6 being a cross section taken along the line VI—VI of FIG. 5. In the second embodiment, a diametrically extending key 23*d* formed on the back surface of the orbiting scroll member 3 and a keyway 14*b* formed in a disc member 14A for receiving the key 23*d* differ in shape from the keys 3*d* and the keyway 4*b* in the first embodiment.

The key 23*d* has a width equal to or wider than the outer width of the bearing boss 3*c* of the orbiting scroll member 3. Accordingly, no structural portion which may hinder the movement of the bearing boss 3*c* is present, and this provides advantage in that it is possible to reduce the diameter of the disc member 14A or that of each of the end plates. In addition, the contact area between the key 23*d* and the keyway 14*b* can be increased and thus the level of pressure per unit area is reduced. This is advantageous in terms of durability. The sealing effect of the second embodiment is of course completely the same as that of the first embodiment shown in FIG. 2.

Figure 7:
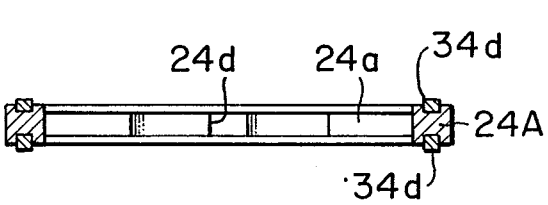
FIG. 7 is a longitudinal section of the essential portion of a third preferred embodiment of the anti-rotation mechanism in accordance with the present invention.
Figure 8:
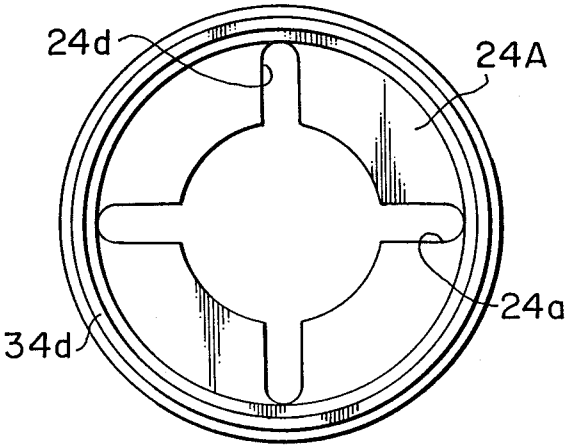
FIG. 8 is a top plan view of the anti-rotation mechanism shown in FIG. 7.

FIG. 7 illustrates a third preferred embodiment of the anti-rotation mechanism in accordance with the present invention, FIG. 8 being a top plan view of the anti-rotation mechanism shown in FIG. 7. FIGS. 7 and 8 essentially show the structure of a disc member 24A of the anti-rotation mechanism which employs a sealing method different from those used in the first and second embodiments.

As described previously, in the first and second embodiments shown in FIGS. 2 and 5, one of the sealing surfaces of the disc member 4 (or 14) has a flat form.

However, the third embodiment has a structure in which ring-shaped seal members 34*d* are disposed on opposite sides of the disc member 24A for sealing purposes. The usage of the third embodiment is completely the same as that of the first embodiment shown in FIG. 2.

The present invention is not confined solely to the above-described respective embodiments. As long as the anti-rotation mechanism having the function of sealing the back-pressure chamber formed in the casing by the back surface of the orbiting scroll member, various alternations and modifications may be employed, and the present invention of course embraces such alterations and modifications.

As described above, in the illustrative embodiments of the invention, the back-pressure chamber defined in the casing by the back surface of the orbiting scroll member is air tightly sealed by the anti-rotation mechanism. This eliminates the necessity for sealing the back-pressure chamber by means of the wall of the frame, so that the diameter of the end plate of the orbiting scroll member may be reduced to a minimum diameter required for formation of the compression chamber. Accordingly, the diameter of the compressor can be minimized without sacrificing the simplicity of the structure of a system in which the orbiting scroll member is pressed against the fixed scroll member by a back pressure to airtightly seal the compression chamber. In addition, in accordance with the present invention, the Oldham's ring serving as the anti-rotation mechanism is integral with the sealing mechanism, and this arrangement enables the keys to be spaced a long distance apart in the Oldham's ring, thereby providing an effect of reducing a load applied to each of the Oldham key. It will be appreciated by those skilled in the art that, in a system in which no back pressure acts upon the back surface of the orbiting scroll member, the aforesaid anti-rotation mechanism functions as a thrust bearing.

As described above, in accordance with the present invention, the anti-rotation mechanism provided with a sealing function is interposed between the back surface of the end plate of the orbiting scroll member opposite to the wrap and the flat portion of the frame facing the back surface. Thus, the chamber for accommodating the crankshaft can be airtightly separated from the suction chamber to form an airtightly closed space. In this manner, the anti-rotation mechanism is provided with a sealing function or a thrust-bearing function without having to form a wall surface of the frame along the outer periphery of the anti-rotation mechanism as a wall member for airtightly separating the suction chamber from the outer periphery of the crankshaft chamber. Accordingly, it becomes unnecessary that the outer diameter of the end plate of the orbiting scroll member and the outer diameter of the frame be made greater than that of the anti-rotation mechanism.

What is claimed is:

1. In a scroll compressor having a casing in which is operatively arranged a compressor assembly having a fixed scroll member and an orbiting scroll member engaged therewith, a suction chamber being formed along outer peripheries of said fixed scroll member and said orbiting scroll member, said fixed scroll member having an end plate provided with a central discharge port, said orbiting scroll member being further engaged with an anti-rotation mechanism; a crankshaft for driving said orbiting scroll member; a frame operatively supporting the aforesaid components in the casing; and a back-pressure chamber being formed between an end plate of said orbiting scroll member and said frame, said anti-rotation mechanism including a disc member provided with opposed end surfaces and keyways for receiving keys of said orbiting scroll 11 member and keys of said frame, said disc member further having a seal mechanism at its end surfaces which are maintained in contact with a surface on the lack of said end plate of said orbiting scroll member facing said frame and a flat surface of said frame facing said surface on the back of said end plate so as to seal said back-pressure chamber from said suction chamber and bias the orbiting scroll member toward said fixed scroll member.

2. An anti-rotation mechanism for a scroll compressor according to claim 1, wherein said orbiting scroll member has a bearing boss operatively associated with said crankshaft and an Oldham key on said back surface of said orbiting scroll member end plate, said Oldham key being fitted into said keyway formed in said disc member of said anti-rotation mechanism and said Oldham key having a width at least equal to an outer width of the bearing boss of said orbiting scroll member.

3. An anti-rotation mechanism for a scroll compressor according to claim 1, wherein said disc member of said anti-rotation mechanism has sealing surfaces at said disc member opposed end surfaces.

4. An anti-rotation mechanism for a scroll compressor according to claim 3, wherein said disc member of said anti-rotation mechanism is provided with an annular seal member on at least one of said disc member end surfaces.

* * * * *